United States Patent [19]

Oldfield et al.

[11] Patent Number: 4,601,266

[45] Date of Patent: Jul. 22, 1986

[54] PHASING DEVICE FOR MACHINE APPLICATIONS

[75] Inventors: Benjamin D. Oldfield, Cheadle; Phillip J. Owen, Stockport; Colin Hague, Worsley, all of England

[73] Assignee: Renold PLC, Manchester, England

[21] Appl. No.: 682,793

[22] Filed: Dec. 18, 1984

[30] Foreign Application Priority Data

Dec. 30, 1983 [GB] United Kingdom ..... 8334619
Nov. 12, 1984 [GB] United Kingdom ..... 8428578

[51] Int. Cl.[4] ..... F01L 1/34

[52] U.S. Cl. ..... 123/90.15; 123/90.18; 464/2

[58] Field of Search ..... 123/90.18, 90.17, 90.15, 123/90.12; 464/2

[56] References Cited

U.S. PATENT DOCUMENTS

| | | | |
|---|---|---|---|
| 1,527,456 | 2/1925 | Woydt et al. | 123/90.17 |
| 2,191,459 | 2/1940 | Duncan | 123/90.17 |
| 3,401,572 | 9/1968 | Bailey | 123/90.18 |

FOREIGN PATENT DOCUMENTS

| | | |
|---|---|---|
| 0042368 | 12/1981 | European Pat. Off. . |
| A112494 | 7/1984 | European Pat. Off. . |
| 368775 | 2/1923 | Fed. Rep. of Germany . |
| 3210914 | 9/1983 | Fed. Rep. of Germany . |
| 500724 | 2/1939 | United Kingdom . |
| 503653 | 4/1939 | United Kingdom . |
| 1003180 | 9/1965 | United Kingdom . |
| 1121855 | 7/1968 | United Kingdom . |
| 2120320 | 11/1983 | United Kingdom . |

*Primary Examiner*—Ira S. Lazarus
*Attorney, Agent, or Firm*—Frishauf, Holtz, Goodman & Woodward

[57] ABSTRACT

An infinitely variable phase adjuster for e.g. adjusting internal combustion piston engine valve timing by selecting the relative rotational positions of the engine crankshaft and a camshaft of the engine. Control is effected by adjusting a "lock" volume of oil on one side of a pressure fluid operable member displaceable to shift the phase.

17 Claims, 6 Drawing Figures

PHASING DEVICE FOR MACHINE APPLICATIONS

The present invention relates to a phasing device for machinery applications and more particularly, although not exclusively, for adjusting the valve timing of an internal combustion engine throughout a predetermined range of adjustment.

It is known to provide a phasing device which is operable to select different relative rotational positions of the crankshaft of an internal combustion piston engine and a camshaft of the engine driven by the engine to open and close intake and/or exhaust valves of the engine in timed sequence with respect to the reciprocation of the pistons of the engine in the engine cylinders.

As is well appreciated already, the "valve timing" of an internal combustion piston engine significantly affects the performance of the engine at different rotational speeds and unless some such phasing device is incorporated, a compromise has to be made to match the engine performance to the intended purpose of the engine.

An object of the present invention is to provide an infinitely variable phase adjuster suitable for adjusting the valve timing of an internal combustion piston engine throughout a predetermined range of adjustment whereby an optimum engine performance may be achieved at more than one engine speed and the overall performance of the engine improved.

More particularly, it is an object of the present invention to provide an infinitely variable phase adjuster suitable for this purpose which is of durable, low cost construction.

Whilst a phase adjuster suitable for adjusting valve timing in an internal combustion piston engine is being described, it is to be understood that a phase adjuster according to the present invention may be used with advantage for any machinery application requiring a phase shift to optimise the operation under varying operating parameters and this applies particularly in cases where a mechanical device such as a cam is driven from a drive shaft transmitting high vibration torque.

According to one aspect of the present invention there is provided an infinitely variable phase adjuster comprising a rotatable member adapted to be driven in rotation from a drive shaft in a predetermined fixed angular relationship therewith, a further member connectible to drive a further shaft in a fixed angular relationship therewith, and drive transmission means connected to drive said further member in rotation from said rotatable member, said drive transmission means including a pressure fluid operable member displaceable axially with respect to said rotatable member and said further member and rotatable therewith, and cam means adapted progressively to rotate said further member relative to said rotatable member with axial displacement of said axially displaceable member relative thereto, the cam means comprising radially directed, helically twisted, drive transmitting surfaces on said pressure fluid operated member arranged in confronting, drive transmitting relation with corresponding helically twisted, drive transmitting surfaces on one of said rotatable and further members respectively.

Preferably, the drive transmission means comprises further radially directed, axially straight, drive transmitting surfaces on said pressure fluid operable member arranged in confronting, drive transmitting relation with corresponding, axially straight, drive transmitting surfaces on the other of said rotatable and further members respectively.

The drive transmitting surfaces are preferably few, and typically four only are provided. However, there could be just three such helically twisted and axially straight surfaces or perhaps five or six such surfaces in each case. By providing only a few drive transmitting surfaces, it is ensured that the surfaces are placed at reasonably large diameters and are of a reasonable size to reduce contact loadings. Also, backlash can be reduced.

Preferably, a clearance gap is provided between the respective confronting drive transmitting surfaces for the feeding of fluid under pressure therebetween. This may provide for a marked hydraulic cushioning of the drive transmitted between the relatively large surfaces which is particularly useful for quietening the transmission of high vibration torque such as occurs when transmitting drive from an automotive engine crankshaft to a camshaft of the engine or a diesel fuel injector pump of the engine.

Preferably also, fluid is supplied through one of said clearance gaps via a restrictor and is exhausted from a fluid filled space downstream of said gap through a further restrictor. The restrictions thus imposed assist in the axial damping of the axially displaceable member.

Conveniently, the pressure fluid operable member is moulded from resilient plastics material. This has the advantage of reducing cost and further quietening the operation of the device.

According to a further aspect of the present invention, there is provided an internal combustion piston engine having an infinitely variable phase adjuster drivably interconnecting a drive shaft of the engine with a driven shaft of the engine, the phase adjuster comprising a rotatable member connected to be driven in rotation by the drive shaft in a predetermined fixed angular relationship therewith, a further member connected to drive the driven shaft in a fixed angular relationship therewith, drive transmission means connected to drive said further member in rotation from said rotatable member, said drive transmission means including a pressure fluid operable member displaceable axially with respect to said rotatable member and said further member and rotatable therewith and means adapted progressively to rotate said further member relative to said rotatable member with axial displacement of said axially displaceable member relative thereto, valve means operable to admit fluid under pressure to, and to exhaust fluid from, said pressure fluid operable member to cause displacement of said member in opposite axial directions respectively, means for sensing the relative angular positions of the driving and driven shafts respectively and control means responsive to said sensing means and to at least one engine operating parameter for operating said valve means to shift the angular phase relationship of the driving and driven shafts in accordance therewith.

A specific embodiment of the present invention in both its control and device aspects will now be described by way of example, and not by way of limitation, with reference to the accompanying drawings in which:

FIG. 1 is a view taken on line 1—1 in FIG. 2 of a double acting phase adjuster according to the present invention drawn substantially to scale;

FIGS. 2 and 3 are sections on line 2—2 and 3—3 respectively in FIG. 1;

Figure 2:
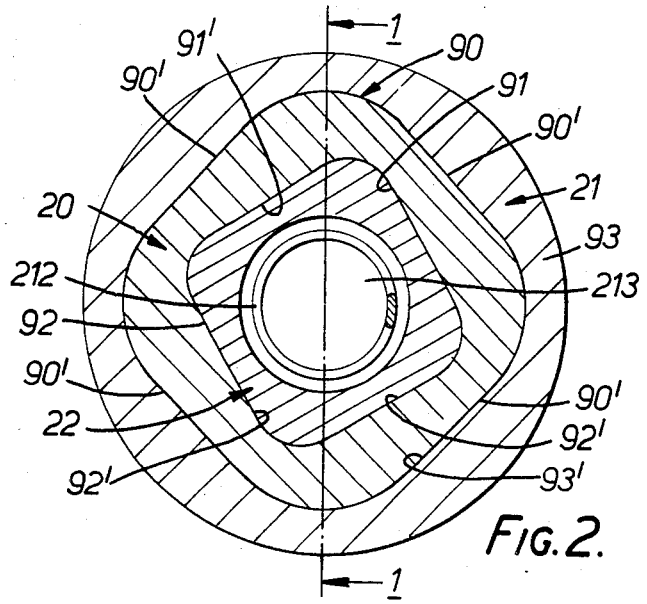
Figure 3:
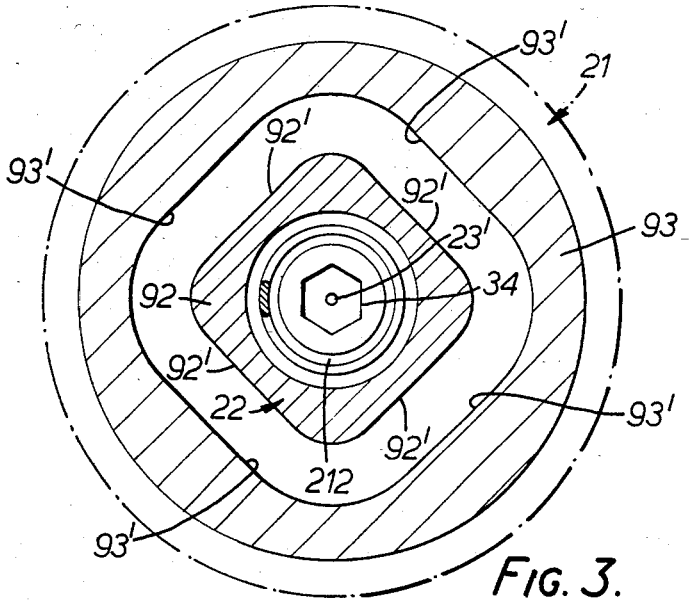

With reference now to the accompanying drawings, the phase adjuster shown in FIGS. 1, 2 and 3 comprises an hydraulically actuable, axially movable square-form piston 20 which is housed in an input drive member 21 and helically keyed to a driven member 22 by cam means 89 hereinafter described. Axial movement of the piston, therefore, allows the angular relationship between the input drive member 21 and the driven member 22 to be adjusted.

Engine oil under pressure is fed into the device from a tapping 23 taken from the camshaft 26 and is allowed to flow through a restrictor 23' into the chamber 57 between the driven member 22 and the piston 20 in order to adjust the device in one direction. Engine oil under pressure fed into a chamber 56 on the other side of the piston 20 adjusts the device in the opposite direction.

The driven member 22 is rigidly fixed to the front end of the camshaft 26, for co-axial rotation therewith, by means of a screw threaded member 34, an eccentric driven peg 36 in the end face of the camshaft engaging in a bore in the member 22 angularly to locate the member 22 in a predetermined fixed angular relationship with the camshaft.

The input drive member 21 which comprises a chain driven sprocket in this example and which is driven by its chain (not shown) in predetrermined fixed angular relationship with the engine crankshaft, is carried by the member 22 for angular adjustment relative thereto about the axis of rotation of the camshaft.

Axial movement of the square-form piston 20 combines an angular relative displacement of the camshaft 26, caused by the helical connection afforded by the cam means 89 with a fixed connection to the sprocket 21, thereby achieving the desired infinitely variable differential angular displacement throughout a predetermined range. Such displacement is achieved under the control of control means 87 hereinafter described.

The piston 20 is of hollow construction and has a straight, generally square-sectioned outer wall 90 with rounded corners, and a helically twisted, generally square-sectioned inner wall 91, with rounded corners, the latter forming one part of the cam means 89 previously referred to. The piston 20 slides on a helically twisted, generally square-sectioned sleeve form part 92 of the driven member 22 forming a further part of the cam means 89, and within a straight, generally square-sectioned housing part 93 of the input drive member 21. The chamber 57 is formed entirely between the piston 20 and the driven member 22. The piston 20 has a surface area c exposed to the oil under pressure bled through the tapping 23 smaller than the surface area b of the piston exposted in the chamber 56 on the other side of the piston.

The helically twisted, generally square-sectioned inner wall 91, with rounded corners, of the piston 20 presents four radially inwardly directed, helically twisted, drive transmitting surfaces 91' on this pressure fluid operated member. These surfaces lie in confronting, drive transmitting relation with corresponding, helically twisted, radially outwardly directed drive transmitting surfaces 92' on the generally square-sectioned sleeve form part 92 of the driven member 22. In a similar way, the straight, generally square-sectioned outer wall 90, with rounded corners, of the piston 20 presents four radially outwardly direct, axially straight, drive transmitting surfaces 90' on the pressure fluid operated member. These surfaces lie in confronting, drive transmitting relation with corresponding axially straight, radially inwardly directed, drive transmitting surfaces 93' on housing part 93 of the input drive member 21.

Figure 1:
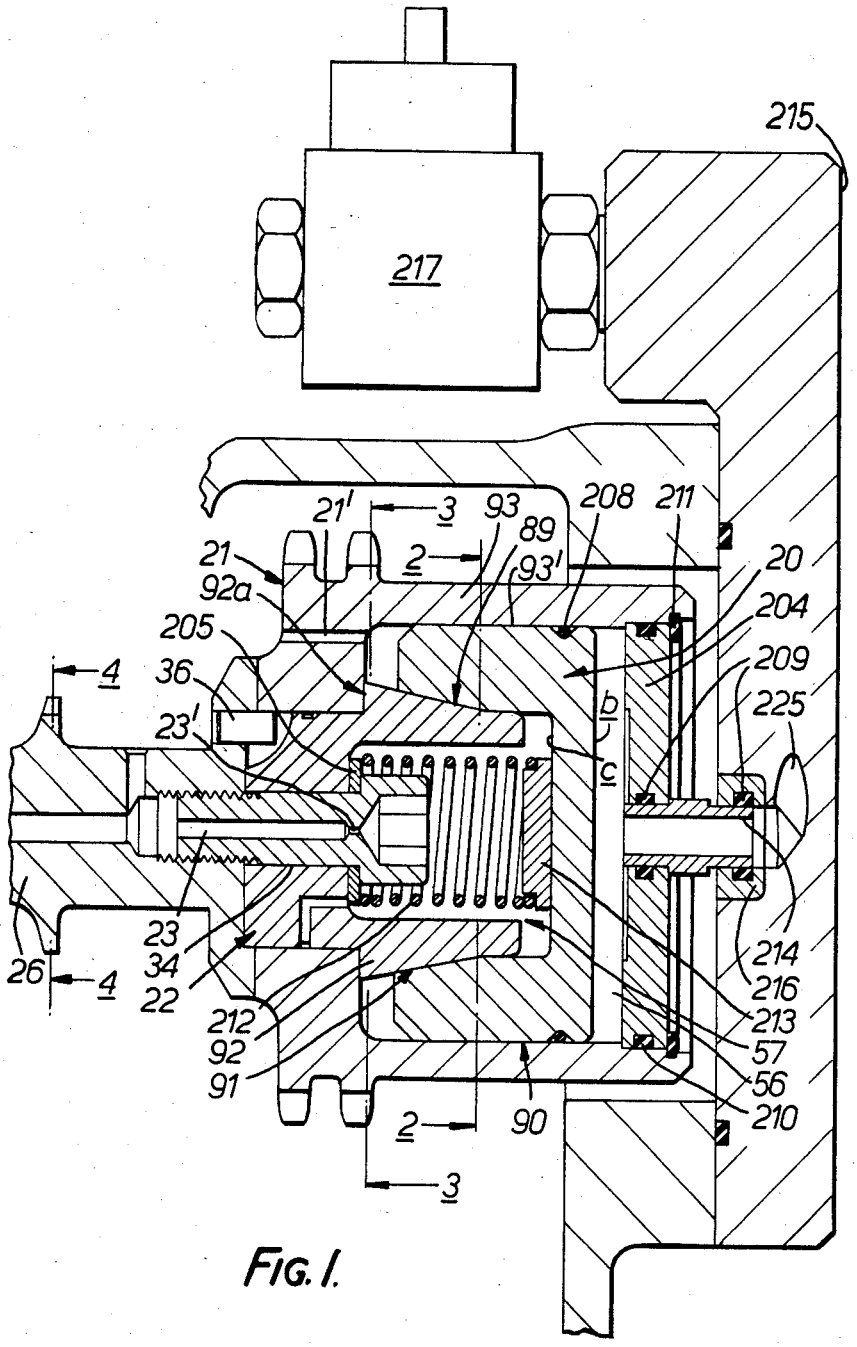

The part 92 of the member 22 extends for approximately half the length of the member 22, the rest of the member, to the left hand side in FIG. 1, having a plane diameter and, as will be understood, the part is of square cross-section with rounded corners in all cross-sectional planes taken through its helically twisted portion. The same applies to the inner wall surface 91 of the piston 20.

The member 21 is rotatably mounted directly on the diameter of the member 22 and a vent hole 21' is provided in the rear flange of the member 21. The member 21 is located axially on the member 22 between the end of the camshaft 26 and a step 92*a* on the member 22, the step 92*a* beginning the helically twisted part 91 of the member 22.

An O-ring 208 seals around the oustide of the piston 20 adjacent the surface b thereof.

An end cap 204 is located in the housing part 93 by a retaining ring 211. A hollow connector 214 is rotatably located in both the end plate 204 and a bush 214. O-rings 209 in these bores assist the sealing of the connector 214. An end plate 215 is mounted to the main casing of the engine and holds the bush 216.

Between the piston 20 and the member 22 is located a washer 205, spring 212 and spring cap 213. This spring 212 provides an axial force on the piston 20.

The control means 87 comprises two solenoid valves 217 mounted on the back of the end plate 215 and these control the passage of oil into and out of separate oilways in the end plate 215 each connected, as indicated at 225, with the bore of the connector 214.

The chamber 56 on the right hand side of the piston 20 is connected, for control purposes, through the connector 214, alternatively with the source of engine oil under pressure which feeds the tapping 23 via the HP solenoid valve 217 (see FIG. 4) and with atomospheric pressure in the engine sump via the LP solenoid valve 217.

High pressure oil fed through the tapping 23 and the restrictor 23' enters the spring housing cavity 57 in the part 92 and leaks between, and wets, the confronting drive transmitting surfaces 91', 92', the oil exiting to sump through the vent hole 21'. This leakage is assisted by the action of centrifugal force when the assembly is rotated and the action of centrifugal force assists additionally in feeding the high pressure oil into a clearance space between the surfaces 93' and 90' and wetting these surfaces also, the clearance being in the range of 0.006 mm to 0.05 mm. The restriction through the clearance between the surfaces 91', 92' which is again in the range of 0.006 mm to 0.05 mm causes fluid pressure to act on the piston 20 assisting the force of the spring 212 urging the piston to the right in FIG. 1 and helping in damping axial movements of the piston 20. Further, damping of the piston axial movements is provided by the restrictor 23'.

The axial position of the piston 20 is infinitely variable within its overall range of axial movement of about 10 mm to rotate the member 22 through an angle of about 15° relative to the member 21 and this position is at all times determined by the volume of oil in the space 56. The pressure of oil in this space 56 is the pressure required, acting on the surface area b of the piston to balance the spring force of spring 212, the oil pressure acting on the surface area c of the piston and in the leakage gap between the surfaces 91', 92' and any axial forces transmitted due to the drive. By controlling the "lock" volume of oil in the space 56, the piston 20 may be located stiffly at any position within its range of axial adjustment.

The "lock" volume of oil is controlled by the LP and HP solenoid valves 217. With both these valves closed, the existing lock volume is maintained to hold the piston 20 stiffly in position. When the HP solenoid valve 217 is opened, high pressure oil enters the space and the volume of oil in the space 56 is increased. The piston 20 is displaced to the left in FIG. 1 to change the phase angle between the shafts being phased. Re-closing the HP solenoid valve 217 re-sets the phase angle to a different valve. Correspondingly, by opening the LP solenoid valve 217, the piston 20 is caused to move to change the phase angle back to, or towards, or beyond, its original setting, the volume of oil in the space 56 being reduced and again being "locked" when the LP solenoid valve 217 is re-closed.

Figure 4:
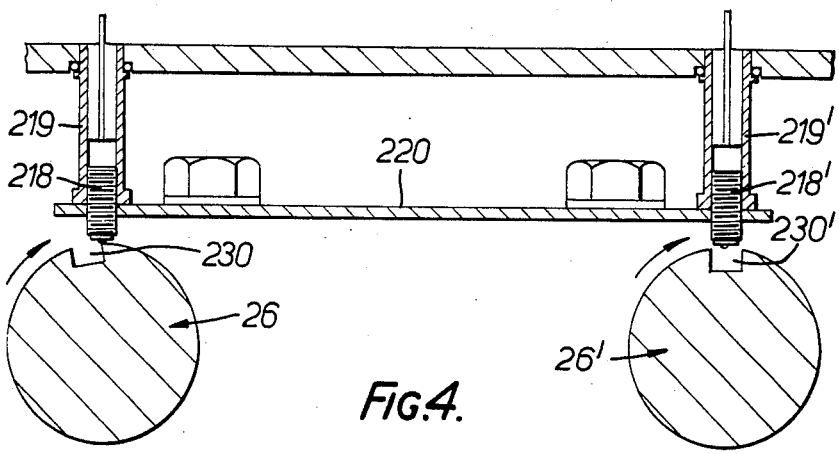
FIG. 4 is a section on line 4—4 in FIG. 1 showing the sensing means.
Figure 5:
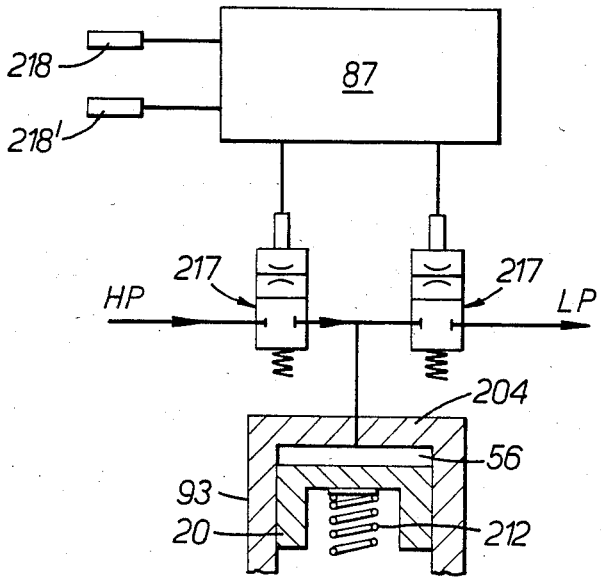
FIGS. 5 and 6 are diagrams of the method of control.
Figure 6:
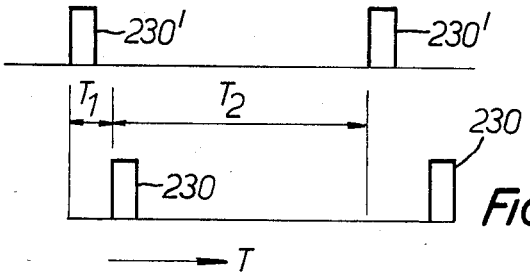

Referring to FIG. 4, the engine overhead exhaust and inlet camshafts 26, 26' are indicated, driven in a clockwise direction shown by the arrows. An axial slot 230, 230' is provided in each camshaft. Two inductive transducers 218, 218' are fixedly mounted in holders 219, 219' on a stationary mount plate 220 so as to lie one adjacent each of the camshafts and so as to engage the camshaft rotating surface in a region so as to intersect the slot 230 or 230' in the shaft once in each revolution of the camshaft. With this arrangement, a signal pulse is produced by each transducer 218 or 218' each time the leading edge of the slot 230 or 230' passes under the transducer tip. This condition is shown for the shaft 26 in FIG. 4. The signal pulses signal the relative angular positions of the two camshafts, i.e. the phase angle between the respective cam forms of the camshafts. After suitable signal conditions, the signals are as indicated in FIG. 6 in terms of the relative positions of the slots 230, 230' with time T.

The engine management system computer 87, in this instance, measures the phase angle and speed of the camshafts in accordance with the following equations:

$$\text{Phase angle} = \frac{T1}{(T1 + T2)} \times 360°$$

$$\text{Speed} = \frac{K}{(T1 + T2)} \text{ R.P.M.}$$

where K is a suitable constant.

The phase angle and speed of the camshafts are continuously compared by the computer with values of phase angle and speed in a pre-programmed table of optimum values (so called "look-up table") held by the computer and the management system continuously adjusts out any difference in the phase angle by switching the HP and LP solenoid valves 217, taking into account, for example, the actual valve response, the instant engine acceleration or deceleration and signal filtering, to obtain the engine performance programmed in the computer.

Since the actual rotational positions of the camshafts are continuously detected in this example, the control system described compensates for chain or belt drive wear, and other errors in timing which might otherwise arise initially, due to machining tolerances and so on.

The slot 230 and transducer 218 may, of course, be associated with the engine crankshaft, if desired, directly to adjust the phase angle between the drive shaft and the driven inlet camshaft of the engine instead of indirectly, the exhaust camshaft, of course, being driven in fixed phase relationship with the engine crankshaft by the chain drive.

Whilst the method of control now being described processes and responds to information concerning the engine speed, it will be appreciated that other control parameters such as throttle opening or manifold depression data may be used in addition to, or in substitution for, the engine speed. Also, by associating the inductive transducer 218' with a slot in the engine crankshaft, the engine performance may be controlled directly in accordance with the phase angle appertaining between the crankshaft and a chosen camshaft of the engine, or again, any chosen driven shaft driven in timed relation with the crankshaft, and so on.

The piston 20 is formed as a moulding from "Victrex Polyethersulphone" which is a proprietary material marketed by I.C.I. This is a resilient plastics material having a 30% filling of reinforcement fibre.

It will be appreciated that the helically twisted, drive transmitting surfaces 91', 92' and the axially straight drive transmitting surfaces 90' 93' may be interchanged as to position if desired, the helically twisted surfaces being formed respectively on the outside of the piston 20 and the inside of the housing part 93' of the input drive member 21 and the axially straight surfaces being formed respectively on the inside of the piston 20 and on the outside of the part 92 of the driven member 22.

The arrangement described with reference to the drawings occupies very little space in front of the engine, which is at a premium in an automotive application. The device, as such, consists of a single, major moving part, namely the piston 20 which may readily be manufactured as a moulding, thus cheapening production. The transmission of high vibration torque is accomplished via surfaces of relatively large area and at large diameter, thereby minimising stresses and providing a long operational life. The device is infinitely variable in adjustment and capable of precision setting due to its hydraulic "lock" and adjustments of the device under control of the management system are subject to adequate damping to avoid transient disturbances. Additionally, the relatively large area of the drive transmission surfaces and the hydraulic cushioning of the surfaces provides for quiet operation which is, again, an advantageous feature in an automotive application.

We claim:

1. An infinitely variable phase adjuster comprising a rotatable member adapted to be driven in rotation from a drive shaft in a fixed angular relationship therewith, a further member connectible to drive a further shaft in a fixed angular relationship therewith and drive transmission means connected to drive said further member in rotation from said rotatable member, said drive transmission means including a pressure fluid operable member displaceable axially with respect to said rotatable member and said further member and rotatable therewith and cam means adapted progressively to rotate said further member relative to said rotatable member with axial displacement of said axially displaceable member relative thereto, the cam means comprising radially directed, helically twisted, drive transmitting surfaces on said pressure fluid operable member arranged in confronting, drive transmitting relation with corresponding helically twisted, drive transmitting surfaces on one of said rotatable and further members respectively.

2. A phase adjuster as claimed in claim 1 in which the drive transmission means comprises further radially directed, axially straight, drive transmitting surfaces on said pressure fluid operable member arranged in confronting, drive transmitting relation with corresponding, axially straight drive transmitting surfaces on the other of said rotatable and further members respectively.

3. A phase adjuster as claimed in claim 1 or 2 in which there are not less than three, and not more than about six, of said drive transmitting surfaces on said pressure fluid operable member.

4. A phase adjuster as claimed in claim 1 or 2 in which a clearance gap is provided between the or the respective confronting drive transmission surfaces for the feeding of hydraulic fluid under pressure therebetween.

5. A phase adjuster as claimed in claim 1 or 2 in which a clearance gap of the order of 0.006 mm to 0.05 mm is provided between the or the respective confronting drive transmission surfaces for the feeding of hydraulic fluid under pressure therebetween.

6. A phase adjuster as claimed in claim 1 or 2 in which a clearance gap is provided between the or the respective confronting drive transmission surfaces for the feeding of hydraulic fluid under pressure therebetween and the hydraulic fluid is supplied through said or one of said clearance gaps via a restrictor and is exhausted from a fluid filled space downstream of said gap through a further restrictor.

7. A phase adjuster as claimed in claim 1 or 2 in which the pressure fluid operable member is a moulding of resilient plastics material.

8. An internal combustion piston engine having an infinitely variable phase adjuster drivably interconnecting a drive shaft of the engine with a driven shaft of the engine, the phase adjuster comprising a rotatable member connected to be driven in rotation by the drive shaft in a predetermined fixed angular relationship therewith, a further member connected to drive the driven shaft in a fixed angular relationship therewith, drive transmission means connected to drive said further member in rotation from said rotatable member, said drive transmission means including a pressure fluid operable member displaceable axially with respect to said rotatable member and said further member and rotatable therewith, and means adapted progressively to rotate said further member relative to said rotatable member with axial displacement of said axially displaceable member relative thereto, valve means operable to admit fluid under pressure to, and exhaust fluid under pressure from, said pressure fluid operable member to cause displacement of said member in opposite axial directions respectively, means for sensing the relative angular positions of the driving and driven shafts respectively, and control means responsive to said sensing means and to at least one engine operating parameter for operating said valve means to shift the angular phase relationship of the driving and driven shafts in accordance therewith.

9. An engine as claimed in claim 8 in which the valve means is arranged to admit fluid under pressure to, and exhaust fluid from, a "lock" volume of fluid on one side of said pressure fluid operable member bounded in part by a surface area of said pressure fluid operable member, the pressure fluid operable member in part defining with an opposite and smaller surface area, a pressure fluid space from which pressure fluid is leaked to low pressure through restriction means.

10. An engine as claimed in claim 9 in which said pressure fluid space houses a spring which acts on said pressure fluid operable member to urge the member in the direction to reduce said "lock" volume.

11. An engine as claimed in any one of claims 8, 9 or 10 in which said driven shaft is the crankshaft and said driven shaft is either an exhaust camshaft or an inlet camshaft of the engine, the other camshaft being arranged to be driven in fixed phase relation with the crankshaft and said sensing means comprises means for sensing the relative angular positions of the inlet and exhaust camshafts respectively.

12. An engine as claimed in claim 8 in which said sensing means comprises inductive transducer means engaging the respective shafts and responsive to the passage of a slot in the surface of the shaft past the transducer means.

13. An engine as claimed in claim 8 in which the valve means comprises respective high pressure and low pressure solenoid valves operable to communicate and "lock" volume with high pressure and low pressure fluid.

14. An engine as claimed in claim 8 in which the means adapted progressively to rotate said further member relative to said rotatable member with axial displacement of said axially displaceable member relative thereto comprises radially directed, helically twisted, drive transmitting surfaces on said pressure fluid operable member arranged in confronting, drive transmitting relation with corresponding helically twisted, drive transmitting surfaces on one of said rotatable and further members respectively.

15. An engine as claimed in claim 14 in which the drive transmission means comprises further radially directed, axially straight, drive transmitting surfaces on said pressure fluid operable member arranged in confronting, drive transmitting relation with corresponding, axially straight drive transmitting surfaces on the other of said rotatable and further members respectively.

16. An engine as claimed in claim 14 or 15 in which a clearance gap is provided between the or the respective confronting drive transmission surfaces for the feeding of hydraulic fluid under pressure therebetween.

17. An engine as claimed in claim 14 or 15 in which a clearance gap is provided between the radially directed, helically twisted drive transmitting surfaces for the feeding of hydraulic fluid under pressure therebetween and the hydraulic fluid under pressure is supplied through said clearance gap via a restrictor and is exhausted from a fluid space downstream of said gap through a further restrictor.

* * * * *